US005511851A

United States Patent [19]

Zivari

[11] Patent Number: 5,511,851

[45] Date of Patent: Apr. 30, 1996

[54] MODULAR STOOL

[76] Inventor: Bashir Zivari, 309 Carroll St., Brooklyn, N.Y. 11231

[21] Appl. No.: 370,504

[22] Filed: Jan. 9, 1995

[51] Int. Cl.[6] ..... A47C 1/124

[52] U.S. Cl. ..... 297/249; 297/248; 297/440.14

[58] Field of Search ..... 297/248, 249, 297/239, 440.14; 108/64

[56] References Cited

U.S. PATENT DOCUMENTS

| | | | |
|---|---|---|---|
| 2,439,322 | 4/1948 | Thaden | 297/239 X |
| 2,988,844 | 6/1961 | Frimberger | 297/440.14 X |
| 3,600,036 | 8/1971 | Iskander | 297/239 |
| 3,944,281 | 3/1976 | Piretti | 297/440.14 |
| 4,341,419 | 7/1982 | Sebel | 297/239 |
| 4,995,668 | 2/1991 | Zavari | 297/249 X |

FOREIGN PATENT DOCUMENTS

| | | | |
|---|---|---|---|
| 8503627 | 8/1985 | WIPO | 297/239 |

*Primary Examiner*—Peter R. Brown
*Assistant Examiner*—David E. Allred
*Attorney, Agent, or Firm*—Michael Ebert

[57] ABSTRACT

A modular stool capable of functioning in a kindergarten or similar facility as an individual seat or as a desk unit for a small child. When interlinked with like stools, one can then create a large ring of stools or a series of staggered stools for group seating, or just a pair of stools forming a love seat. The modular stool is formed from a single blank of plywood or other material that is cut and contoured to define a wedge-shaped seat section and left and right side sections outwardly inclined with respect to the seat section to form an arch. The side sections of each stool are adapted to be interlinked with the side sections of adjacent stools.

14 Claims, 3 Drawing Sheets

FIG. 8
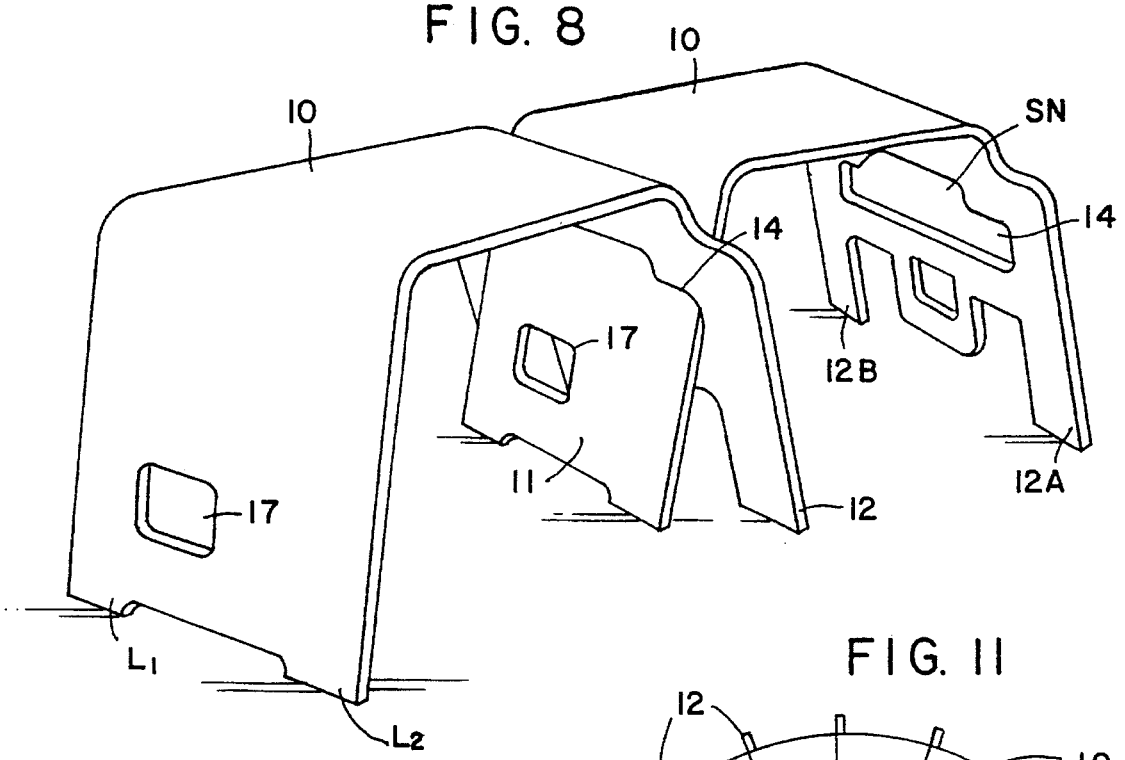
FIG. 11
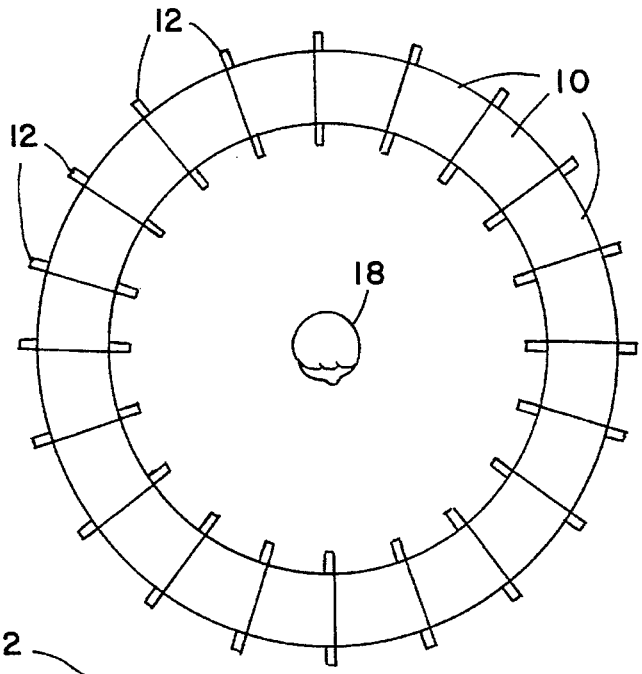
FIG. 9
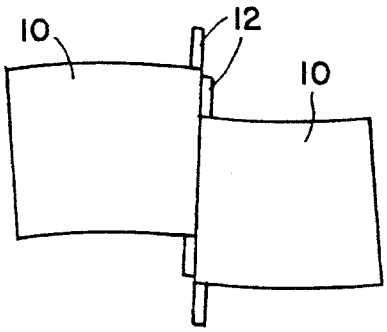
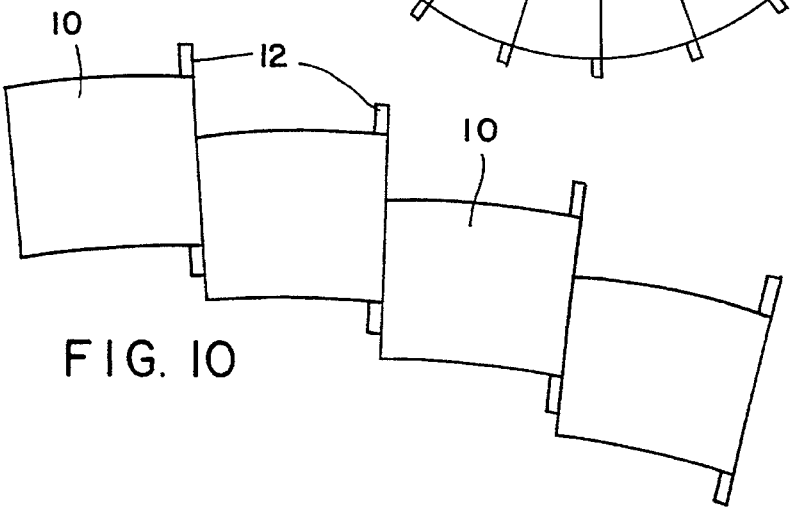
FIG. 10

MODULAR STOOL

BACKGROUND OF INVENTION

1. Field of Invention

This invention relates generally to seating stools, and more particularly to a modular stool usable in schools, kindergartens and other facilities intended for very young children, the stool being capable of functioning as an individual seat or desk unit, or of being so interlinked with like stools as to create different multi-seating configurations.

2. Status of Prior Art

In schools, kindergartens, play rooms and other facilities intended for small children whose ages lie in the four to eight year range, the need exists for chairs or seats as well as desk units in a scale appropriate to these tots. Thus in a kindergarten having a class of twenty children, at least an equal number of chair and desk units are required. While children can play with toys on the floor, a desk unit is desirable, not only to make it more convenient for a child to play with toys, but also to provide an elevated surface on which a child may draw or paint.

The total cost of small chairs and desk units for furnishing a kindergarten or school room is relatively high, even if the cost of an individual chair or stool or of a desk unit is modest. In a period when school budgets are being cut back in order to reduce the tax load on local communities, schools may no longer be able to afford the required number of chairs and desk units.

But apart from the cost factor are space requirements, for one must be able on occasion to clear a kindergarten room of all chairs and desk units in order to provide an unobstructed play area for children. To do this, a storage facility is required to accommodate these furnishings.

In order to reduce storage space requirements, it is known to provide stackable stools or chairs. Thus the Iskander U.S. Pat. No. 3,600,036 discloses reinforced plastic seats that can be stacked one above the other or interlocked in tandem. And the Heyer U.S. Pat. No. 3,430,588, shown three identical stools which can be internested to create a cube requiring relatively little storage space.

My prior 1991 U.S. Pat. No. 4,995,668 discloses a modular stool capable of functioning in a kindergarten or similar facility as an individual seat for a child, which stool when interlinked with like stools can be used for group seating. The stool is comprised of a wedge-shaped seat section whose rear end is broader than its front end, and left and right side sections integral with the seat section and outwardly inclined with respect thereto to form an arch. The left side section is defined by a broad single leg centered with respect to the left and right ends of the seat section, the right side section being defined by left and right narrow legs joined to the front and rear ends of the seat section. Also included is a cross arm bridging the narrow legs below the seat section to define a transverse slot whose width is substantially equal to that of the broad leg, whereby two stools may be interlinked by inserting the broad leg of one into the slot of the other.

The stool disclosed in my prior patent, though effective for its intended purposes, leaves something to be desired under certain circumstances. When the patented stool is placed on a floor, then resting on the floor surface are the narrow left and right legs of one side section of the stool, and the single broad leg of the other side section. Should the floor have an even surface, the three legged stool is then stable and a child sitting on the stool cannot rock it. But should the floor surface be uneven, as is sometimes the case, the stool may then be somewhat unstable, for the lower edge of the broad leg will not be flush with the uneven floor surface.

Another problem encountered with the patented stool is possible finger entrapment when the stool is being interlinked with a like stool by inserting the broad leg of one stool in the transverse slot in the other stool. The width of this slot matches the width of the broad leg, and the broad leg inserted in the slot then engages the upper edge of the slot. In making this insertion, there is a danger that the fingers of the operator grasping the broad leg may become entrapped in the slot, the fingers then being interposed and squeezed between the broad leg and the upper edge of the slot in which the leg is inserted.

Both safety and stability are important factors in the environment of a kindergarten or playroom, for the children who manipulate and use these stools cannot be counted on to exercise care in this activity. It is important, therefore, that the stools be, as it were, "fool-proof" so that regardless of how carelessly the stools are interlinked, there is no danger of finger entrapment, and regardless of the condition of the floor surface on which the stools are placed, the stools are stable.

Also of prior art background interest are the following patents:

| | | |
|---|---|---|
| 2,890,087 | 6/1959 | Stevens |
| 2,891,601 | 6/1959 | Mauser |
| 3,669,494 | 6/1972 | Lohmeyer |
| 3,774,962 | 11/1973 | Watamura et al. |
| 3,994,281 | 3/1976 | Piretti |

SUMMARY OF INVENTION

In view of the foregoing, the main object of this invention is to provide a stool module usable in kindergartens, schools, play rooms and other facilities intended for very young children, the stool being capable of functioning as an individual seat or desk unit, or being so interlinked with like stools as to create different multi-seat configurations.

A significant feature of a stool in accordance with the invention is that it is a stable on floors regardless of whether the floor surface is even or uneven, and there is no danger when the stools are being interlinked, that the fingers of the operator will then be entrapped.

More particularly, an object of this invention is to provide a modular stool of the above type which can be readily stacked, and which in one multi-seat configuration assumes a ring formation; in another a staggered row; and in still another, a two-seater or love seat, which can be extended into a snake-like configuration.

Also an object of this invention is to provide a modular stool which is also usable as a desk unit in which the child sitting on the floor with his legs under the desk surface then has his hands positioned over this surface, thereby making it possible for the child to draw or to play with toys placed on the desk.

Yet another object of the invention is to provide a modular stool of the above type which is formed from a single blank of bendable plywood or similar material, and which may be mass produced at low cost, the stool being capable of surviving rough abuse.

Briefly stated these objects are attained in a modular stool formed from a single blank of plywood or other bendable material that is cut and contoured to define a wedge-shaped seat section and left and right side sections outwardly inclined with respect to the seat section to form an arch, the side section of the stool being adapted to be interlinked with side sections of adjacent stools to create a large ring of stools or a series of staggered stools for group seating, or just a pair of stools forming a love seat.

The right side section includes a pair of parallel narrow legs which are joined to the front and rear ends of the seat section and extend beyond these ends to provide a broad-stance stable support for the seat section. The narrow legs of this side section are bridged by a cross beam that is spaced from the seat section by a transverse slot. Depending from the center of the beam is a plate having a socket hole therein.

The upper edge of the transverse slot is indented to create a safety notch to accommodate the fingers of an operator. The left side section is formed by a broad panel whose width corresponds to the width of the seat section, the lower edge of the panel being notched to create a pair of spaced short legs providing a stable support for the seat section. The panel is provided with an off-center keyhole whose opening has the same width as that of the socket hole in the plate.

When the stools are to be interlinked in a ring formation, inserted by hand in the transverse slot in the right side section of one stool is the left side section of an adjacent stool, whose panel then engages the upper edge of the slot and the fingers of the operator, should they be adjacent to the slot, are then accommodated in the safety notch.

When the stools are to be interlinked to form a staggered row thereof, a narrow-leg in the right side section of one stool is then inserted in the keyhole in the left side section of the adjacent stool to intercouple the stools.

When a pair of stools are to be interlinked to form a love seat, the stools are placed in reverse relationship, one narrow leg in the right side section of one stool being then received in the socket hole of the right side section of the second stool, and one narrow leg of the second stool being received in the socket hole of the first stool.

BRIEF DESCRIPTION OF DRAWINGS

For a better understanding of the invention as well as other objects and further features thereof, reference is made to the following detailed description to be read in conjunction with the accompanying drawings, wherein:

FIG. 8 illustrates the manner in which two stools are interlinked in mating relationship;

FIG. 9 schematically illustrates two stools interlinked in reverse relationship to create a love seat;

FIG. 10 illustrates schematically a row of stools interlinked in staggered relationship; and FIG. 11 illustrates schematically a circular array of stools interlinked in mating relationship to create a seating ring for a large group of children.

DESCRIPTION OF INVENTION

The Modular Stool

A modular stool in accordance with the invention, as shown in FIGS. 1 to 5, is fabricated from a single blank of plywood that is bent, cut and contoured, using well known forming techniques to this end, to create the functional and structural elements of the stool. It will be appreciated that stools in accordance with the invention may be fabricated from other high-strength, relatively light-weight, moldable material, such as laminated plastic sheets or aluminum. The advantage of plywood, apart from its low cost, is that this multi-ply wood product is commercially available with attractive face plies or veneers. The modular stool may also be engineered and manufactured using injection molded plastics.

The blank from which the stool is fabricated is formed into an arch to define a wedge-shaped horizontal seat section 10 whose gently curved rear end 10R is somewhat broader than its gently curved front end 10F, as well as outwardly inclined left and right side sections 11 and 12 functioning as the legs of the stool. The junctions between the seat section and the side sections which are integral therewith are curved, and all exposed edges of the stool are chamfered to avoid sharp points that may cause injury.

Figure 2:
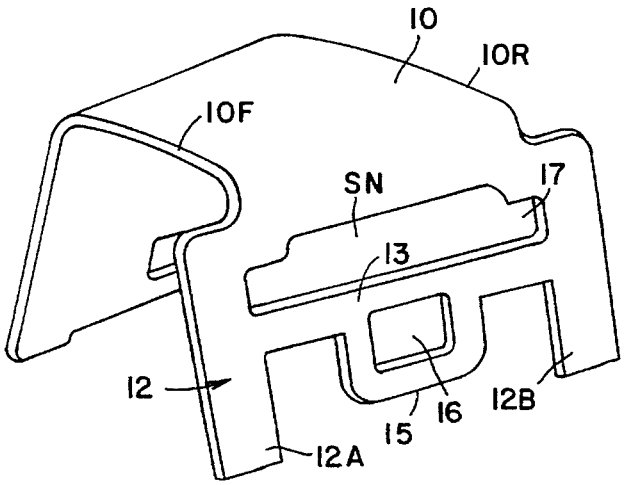
FIG. 2 shows the stool in perspective, as seen looking toward its right side.
Figure 3:
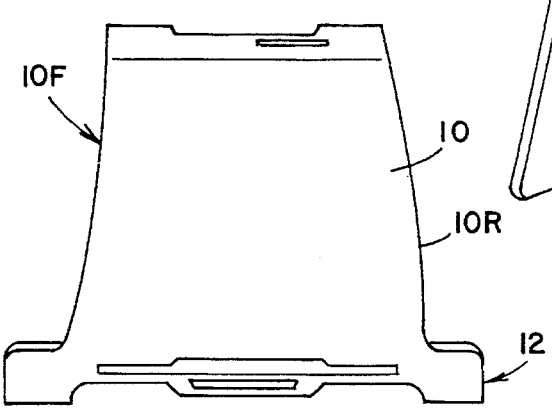
FIG. 3 is a top view of the stool.
Figure 4:
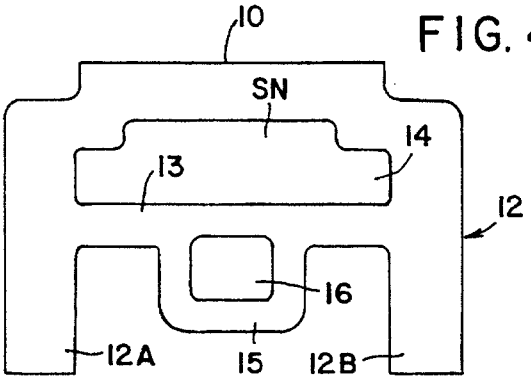
FIG. 4 shows the right side of the stool.

Right side section 12, as best seen in FIGS. 2 and 4, is defined by a pair of narrow legs 12A and 12B of equal width, which are joined respectively to the front and rear ends 10F and 10R of seat section 10 and extend beyond these ends to provide a stable, broad-based support for one side of the seat section. Legs 12A and 12B are bridged by a horizontal cross beam 13 which is spaced from seat section 10 to define a transverse slot 14 extending between these narrow legs. Depending from cross beam 13 and centered with respect thereto is a plate 15 having a rectangular socket hole 16 therein dimensioned to receive a narrow leg of an adjacent stool, the width of this hole being slightly larger than that of a narrow leg. The upper edge of transverse slot 14 is indented to provide an elongated safety notch SN to accommodate the fingers of an operator when the operator inserts an element of an adjacent stool in this slot.

Figure 1:
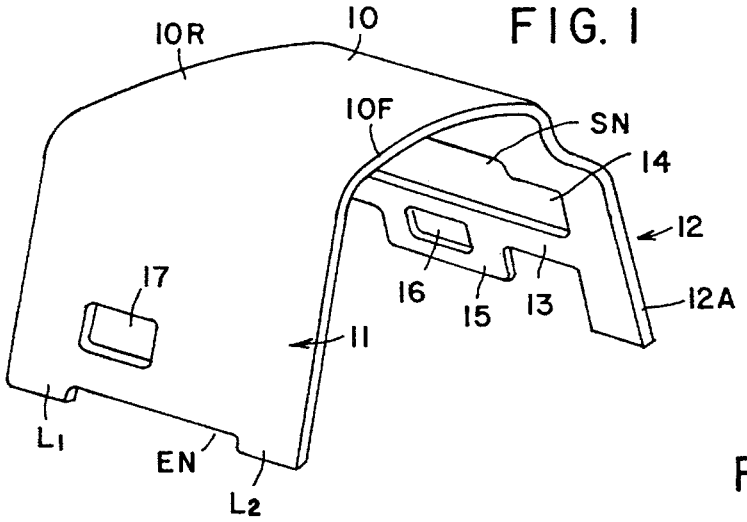
FIG. 1 is a perspective view of a modular stool in accordance with the invention, as seen looking toward its left side.
Figure 5:
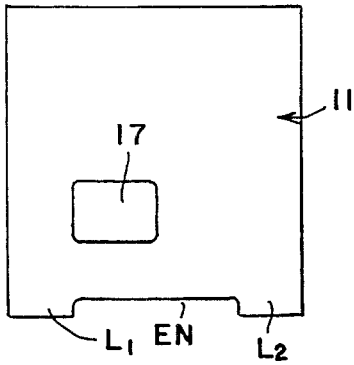
FIG. 5 shows the left side of the stool.

Left side section 11, as best seen in FIGS. 1 and 5, is defined by a single broad panel having the same width as seat section 10 and provided with an off-center keyhole 17 whose dimensions are similar to those of socket hole 15. Thus the width of keyhole should be the same as that of the socket hole but its height may be somewhat less. The lower edge of panel 11 is provided with an elongated notch EN which defines a pair of short parallel legs $L_1$ and $L_2$ which rest on the surface of the floor at spaced positions thereon.

Thus as compared to the three-legged stool disclosed in my prior U.S. Pat. No. 4,995,668, the present stool effectively has four legs. This is a distinct advantage in terms of stool stability, for on an uneven floor surface, each leg provided two points of contact, and the widely distributed eight points of contact accommodate the stool to whatever floor surface the stool is placed on. The wide legged stance of the narrow legs 12A and 12B of the right side section which extends beyond the seat section enhances the stability of the stool on an uneven floor surface. Thus the stool is stable regardless of the unevenness of the floor surface on which the stool is placed.

All elements of the modular stool serve a useful function and make it possible, as will later be explained, to so interlink like stools as to form a circular array of stools or a staggered row of stools for group seating, or just a pair of stools to create a double-seat or love seat, which can be extended into a snake-like configuration.

Each stool provides an individual free-standing seat for a small child. In one actual embodiment of this stool made from bent plywood, the plywood has a ½ inch thickness and the stool is 12 inches in height, the width of the left side section being 18 inches and that of the right side section being 12 inches. The length of the front end of the wedge shaped seat section is 12 inches and that of the rear end, 15 inches. It will be appreciated that the stool may in practice have other dimensions and can be made in sizes suitable for older children or adults.

The stool can also function as a desk, for the child may sit on the floor with his legs under the stool so that his hands are above the seat section which then serves as a desk surface on which the child can draw or play with toys. And because the side sections are outwardly sloped, the modular stools may be stacked, one above the other, thereby reducing the required storage space for a large number of stools.

Circular Array

As shown in FIG. 11, the stools may be interlinked in mating relationship to create a circular array thereof forming a large ring for group seating in a kindergarten, a classroom or other facility in which the teacher 18 is positioned within the ring and the children seated on the stools face the teacher with their legs within the ring, thereby confining the group of seated children. The advantage of this ring arrangement is that it affords the teacher better control of her class of toddlers. With the stool dimensions given above, twenty such stools, when interlinked, create the desired large circle of stools.

The manner in which the stools are interlinked to form a circle is shown in FIG. 8, where it will be seen that the broad panel 11 of the right stool is received in the transverse slot 14 of the left stool, thereby interlinking the two stools in mating relationship. Because of the wedge shape of seat section 10 and the concentric curvature of its front and rear end, the two interlinked stools are not in a straight line but in an arc. Successive stools are similarly interlinked to complete the circle.

Staggered Row

In the arrangement shown in FIG. 10, the modular stools are so interlinked as to create a series of stools in a staggered row whose length depends on the number of stools.

Figure 7:
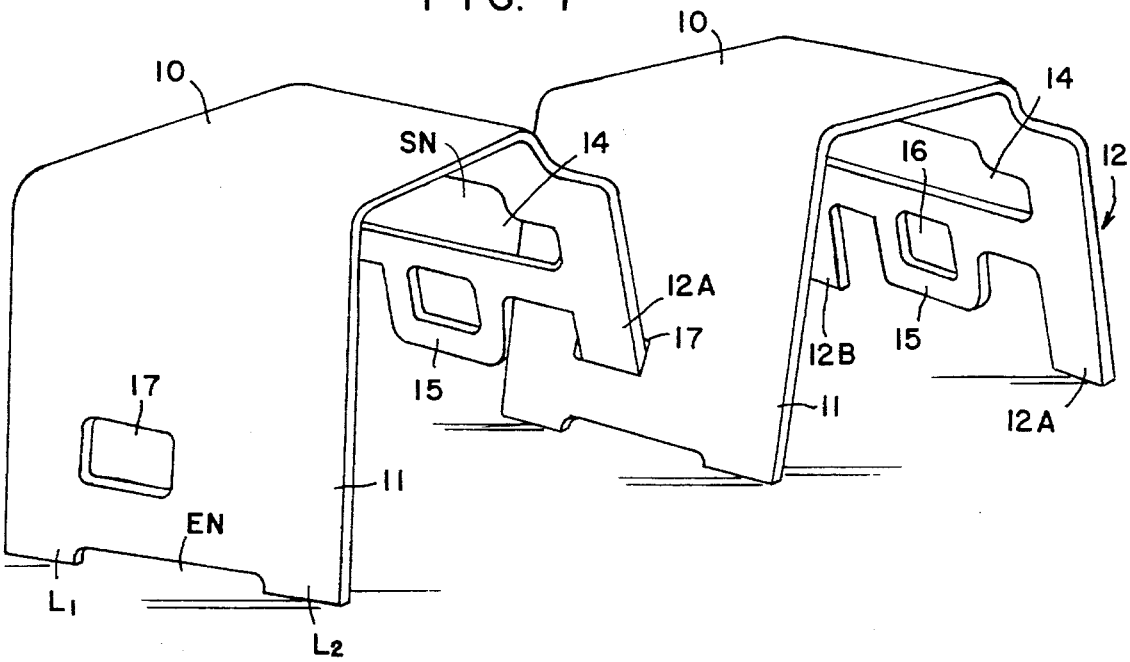
FIG. 7 illustrates the manner in which two stools are interlinked in staggered relationship.

The manner in which stools are interlinked to create a staggered row of stools is shown in FIG. 7, where it will be seen that the front narrow leg 12A of the left stool is inserted in the keyhole 17 of the broad panel 11 of the right stool, the right leg 12B of the left stool then being free so that now the left stool is offset somewhat from the right stool to which it is linked. Succeeding stools in the staggered row are similarly interlinked by way of the keyholes 17 in the broad panels 11 into which narrow legs 12A are inserted.

Love Seat

Figure 6:
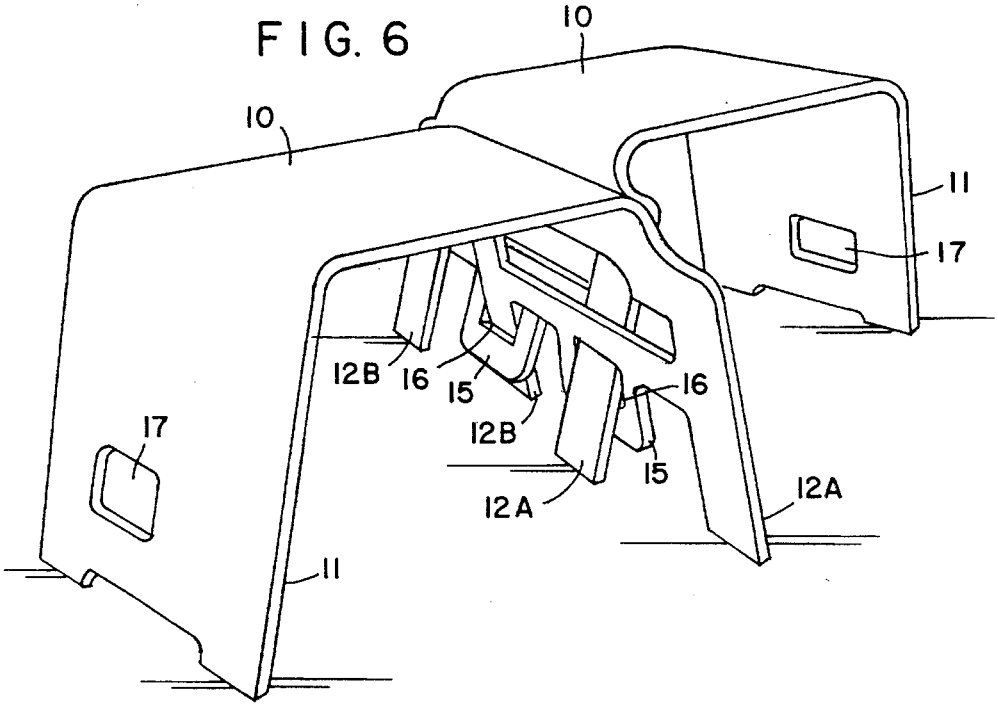
FIG. 6 illustrates the manner in which two stools are interlinked in reverse relationships.

In the love seat configuration as shown in FIGS. 6 and 9, a pair of stools are interlinked by way of their socket holes 16 in plates 15. The right stool is in reverse relation with respect to the left stool, with the front leg 12A of the rights stool received in keyhole 16 of the left stool and the rear leg 12B of the left stool received in the keyhole 16 of the right stool, thereby interlinking the two stools to create a love seat in which the seated individuals are seated in opposed relation.

Advantages

It will be appreciated that because of transverse slot 14, keyhole 16 and socket hole 17 included in each modular stool, the stools may be interlinked in various ways to provide different multi-seating patterns. The narrow legs on the right side section of each stool which extend beyond the front and rear ends of the seat section, serve not only to enhance the stability of the stools, but also when the stools are interlinked to provide a foot-separating partition between adjacent stools.

This foot-separating partition is useful when the stools are occupied by small children who are characteristically free with their feet and might therefore playfully try to kick the feet of an adjacent child. It is to be understood however that the stool which is remarkably strong are also capable of supporting adults may be made in sizes suitable for adults or older children.

While there has been disclosed a preferred embodiment of a modular stool in accordance with the invention it will be appreciated that changes may be made thereon without departing from the spirit of the invention.

I claim:

1. A modular stool capable of functioning in a kindergarten or similar facility as an individual seat for a child, which stool when interlinked with like stools can be used for group seating, said stool comprising:

(a) a wedge-shaped seat section whose rear end is broader than its front end;

(b) left and right side sections integral with the seat section and outwardly inclined with respect thereto to form an arch, said left side section being defined by a broad panel whose lower edge is notched to define a pair of spaced short legs, said right side section being defined by fore and aft narrow legs joined to the front and rear ends of the seat section; and (c) a cross beam bridging the narrow legs below the seat section to define a transverse slot whose width is substantially equal to that of the panel, whereby two stools may be interlinked by inserting the panel of one into the slot of the other, said transverse slot having an upper edge which is notched to define a safety space for the fingers of an operator when inserting the panel into the slot.

2. A stool as set forth in claim 1 in which the rear and front end of the wedge-shaped section have concentric curvatures.

3. A stool as set forth in claim 1, further including a plate depending from said cross beam and centered with respect to said narrow legs, said plate having a socket hole therein whose width substantially matches that of a narrow leg, whereby two stools may be interlinked by inserting one narrow leg of one stool in the socket hole of the other.

4. A stool as set forth in claim 1, in which the narrow legs joined to the front and rear ends of the seat section extend beyond these ends to widen said right side section and thereby stabilize the stool.

5. A stool as set forth in claim 3, wherein said panel has an off-center keyhole therein whose dimensions match those of said socket hole, whereby two stools may be interlinked by inserting a narrow leg of one stool in the keyhole of the other stool.

6. A closed ring of like stools of the type set forth in claim 1, in which the stools in the ring are interlinked in mating relationship by inserting the panel of each stool in the ring into the transverse slot of the adjacent stool.

7. A staggered row of like stools of the type set forth in claim 5, in which the stools are interlinked in staggered relationship by inserting a narrow leg of one stool in the row in the keyhole of the adjacent stool.

8. A love seat formed by a pair of like stools as set forth in claim 5, in which the stools are interlinked in reverse relationship, the narrow leg of each stool being inserted in the socket hole of the other stool.

9. A stool as set forth in claim 1, wherein the stool is fabricated from a single blank of plywood contoured and cut to define the sections of the stool.

10. A stool as set forth in claim 9, wherein the side sections at their junctions with the seat section are curved to avoid a sharp transition therebetween.

11. A stool as set forth in claim 9, wherein exposed edges of the stool are chamfered to avoid sharp points.

12. A stool as set forth in claim 1, fabricated from a single blank of laminated sheeting that is contoured and cut to define the sections of the stool.

13. A stool as set forth in claim 12, in which the sheeting is plywood.

14. A stool as set forth in claim 12, in which the sheeting is a laminated multi-ply synthetic plastic.

* * * * *